US005332224A

United States Patent [19]

Libit et al.

[11] Patent Number: 5,332,224

[45] Date of Patent: Jul. 26, 1994

[54] CONVENIENT GOLF GAME WITH ADJUSTABLE OUT-OF-BOUNDS MARKERS

[75] Inventors: Jeffrey M. Libit, 13244 Circulo Largo Court, N.E., Albuquerque, N. Mex. 87112; Sidney Libit, Long Boat Key, Fla.

[73] Assignee: Jeffrey M. Libit, Albuquerque, N. Mex.

[21] Appl. No.: 977,903

[22] Filed: Nov. 18, 1992

[51] Int. Cl.[5] ..... A63B 69/36

[52] U.S. Cl. ..... 273/176 AB; 273/35 B; 273/181 A

[58] Field of Search ..... 273/176, 181, 182, 35 B

[56] References Cited

U.S. PATENT DOCUMENTS

| | | | |
|---|---|---|---|
| 1,489,250 | 4/1924 | Hopwood | 273/181 K |
| 1,584,093 | 5/1926 | Harris | 273/182 R |
| 1,893,278 | 1/1933 | Eriksen | 273/181 F |
| 2,061,973 | 11/1936 | Loeb | 273/182 R |
| 2,232,569 | 2/1941 | Johnson | 273/182 R |
| 2,455,806 | 12/1948 | Reach | 273/176 A |
| 3,860,236 | 1/1975 | Buchanan | 273/35 B |
| 3,861,680 | 1/1975 | Mowrer | 273/35 B |
| 4,148,490 | 4/1979 | Goransson | 273/18 F |
| 4,303,245 | 12/1981 | Brockett | 273/181 A |
| 4,889,342 | 12/1989 | Hugunin | 273/35 B |

FOREIGN PATENT DOCUMENTS

| | | | |
|---|---|---|---|
| 308833 | 3/1989 | European Pat. Off. | 273/176 R |
| 325441 | 2/1930 | United Kingdom | 273/182 R |

*Primary Examiner*—Mark S. Graham

[57] ABSTRACT

A convenient golf game with adjustable out-of-bounds markers which has enclosed tee areas with doors that can be manually or automatically moved to coincide with particular out-of-bound markers. The doors may be pivoted or slidable. Golf shots can be made to a green area that has a number of greens.

4 Claims, 2 Drawing Sheets

FIG. 4
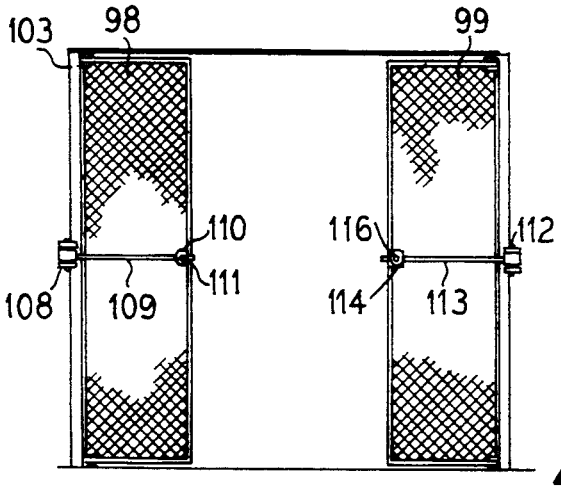
FIG. 6
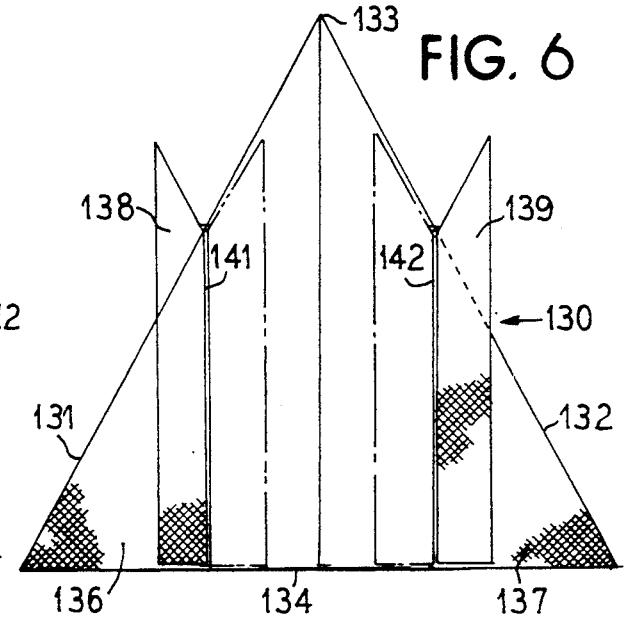
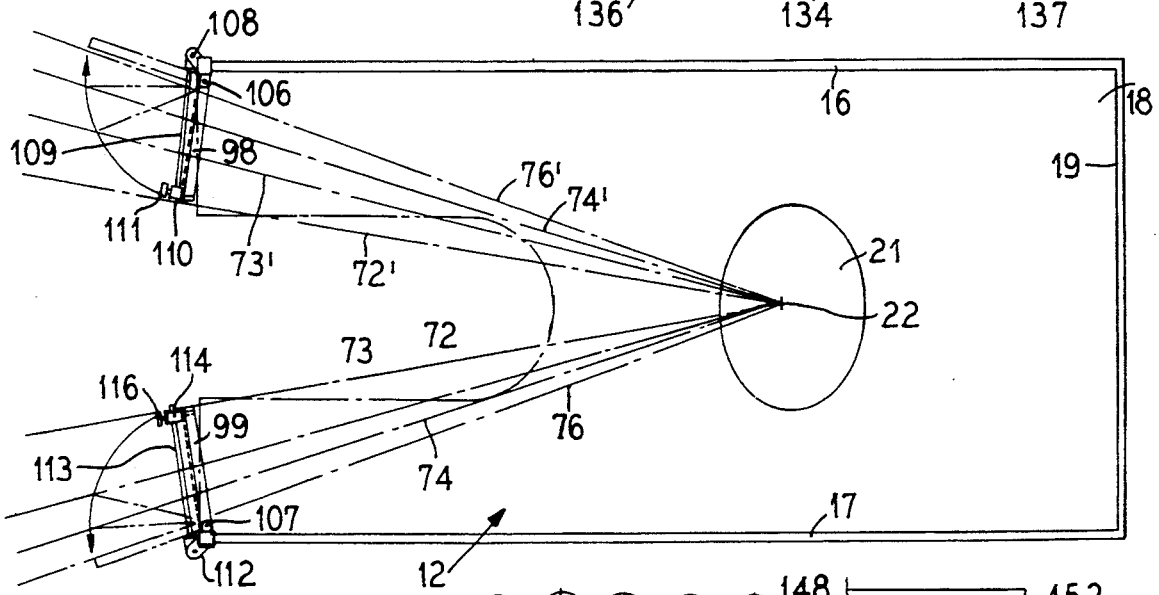
FIG. 5
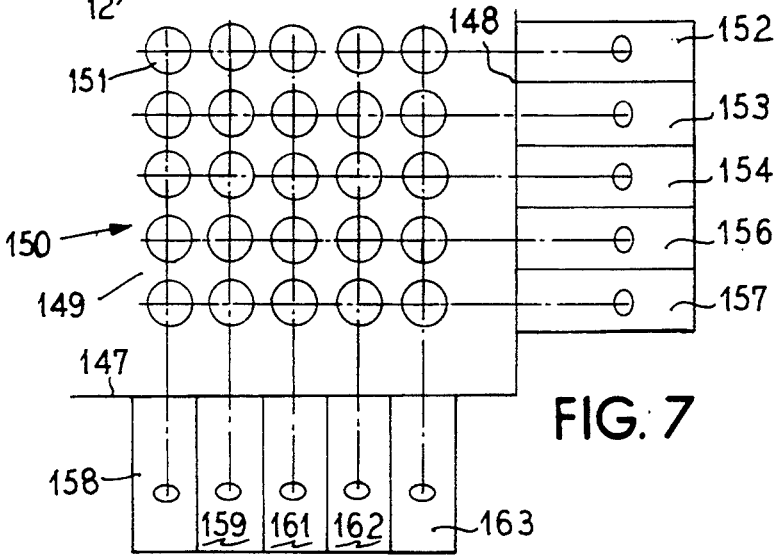
FIG. 7

CONVENIENT GOLF GAME WITH ADJUSTABLE OUT-OF-BOUNDS MARKERS

BACKGROUND OF THE INVENTION

1. Field of the Invention

This invention relates in general to a golf game which allows the players to have the same number of shots and be presented with the same problems that exist on a conventional golf course without requiring large areas of land.

2. Description of Related Art

Prior art simulated golf games do not allow the out-of-bound marker lines to be varied between different holes as occurs in an actual golf course.

SUMMARY OF THE INVENTION

The present invention allows a golfer to play eighteen holes of golf of 6000–7000 yards without walking a single fairway from tee to green.

The game can be played simultaneously by a large number of foursomes hitting from different tee areas to common greens located in a matrix fashion.

In the present game, the golfer has a score card for each hole upon which is printed a layout Of the hole and the yardage of the hole is indicated. Also, the location of the out-of-bound markers are given so that the player can set the actual out-of-bound limits for each hole as they are played. Thus, for some holes the out-of-bound markers may be fairly wide so that the golfer has a large opening through which to shoot which will still result in a fair shot. On other holes where the out-of-bound markers are narrower, the golfer is limited to a shot which falls within such preset limits. For each hole, the golfer adjusts the out-of-bound limits.

Thus, the present invention provides a simulated golf game wherein the golfer hits his golf shots toward a golf green and wherein the out-or-bound markers are set by the golfer so that each hole of an actual golf course is simulated based on the out-of-bound markers that exist for the course.

The cage provides safety to the players.

It is a feature of the present invention that the golfer adjust the out-of-bound lines for each hole as he plays it by manually adjusting the outer door of an enclosed tee area so that the limits of the doors establish the out-of-bound lines for that particular hole. The out-of-bound markers may De adjusted manually or with a suitable driving means such as a motor which is controlled by the player.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 4 is a front plan view of a modified form of the invention;

FIG. 5 is a top plan view of the modified form of the invention illustrated in FIG. 4;

FIG. 6 illustrates another modification of the invention; and

FIG. 7 is a plan view illustrating the layout of a golf course according to the invention.

DETAILED DESCRIPTION OF THE PREFERRED EMBODIMENTS

Figure 1:
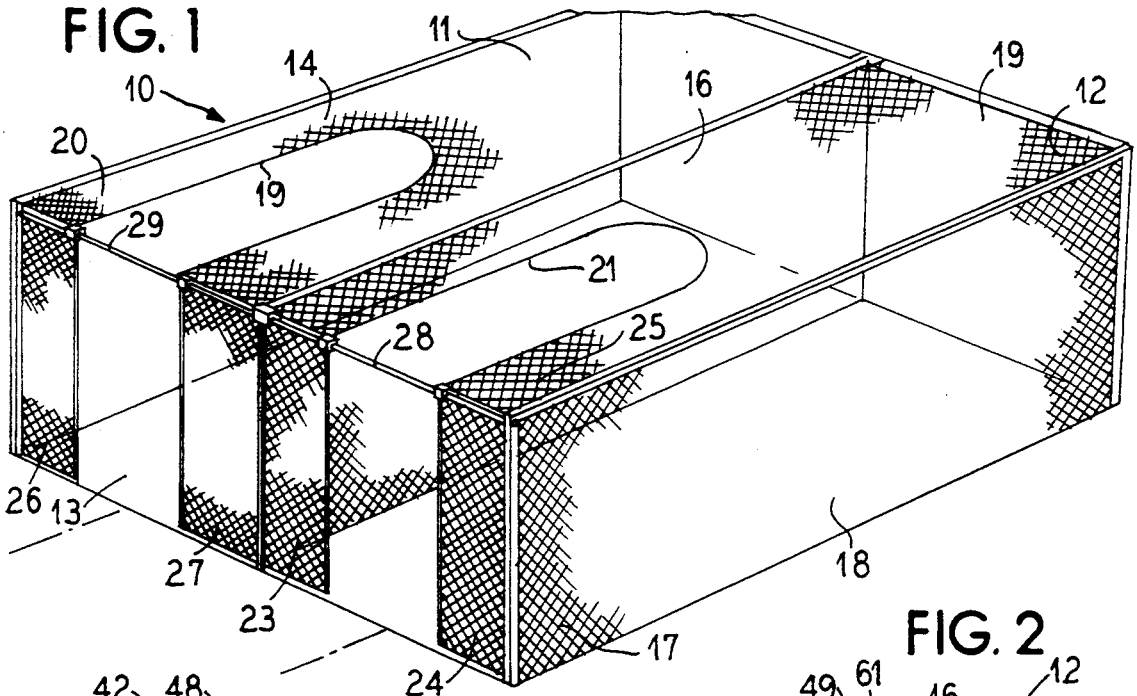
FIG. 1 is a perspective view illustrating two enclosed tee areas of the invention.
Figure 2:
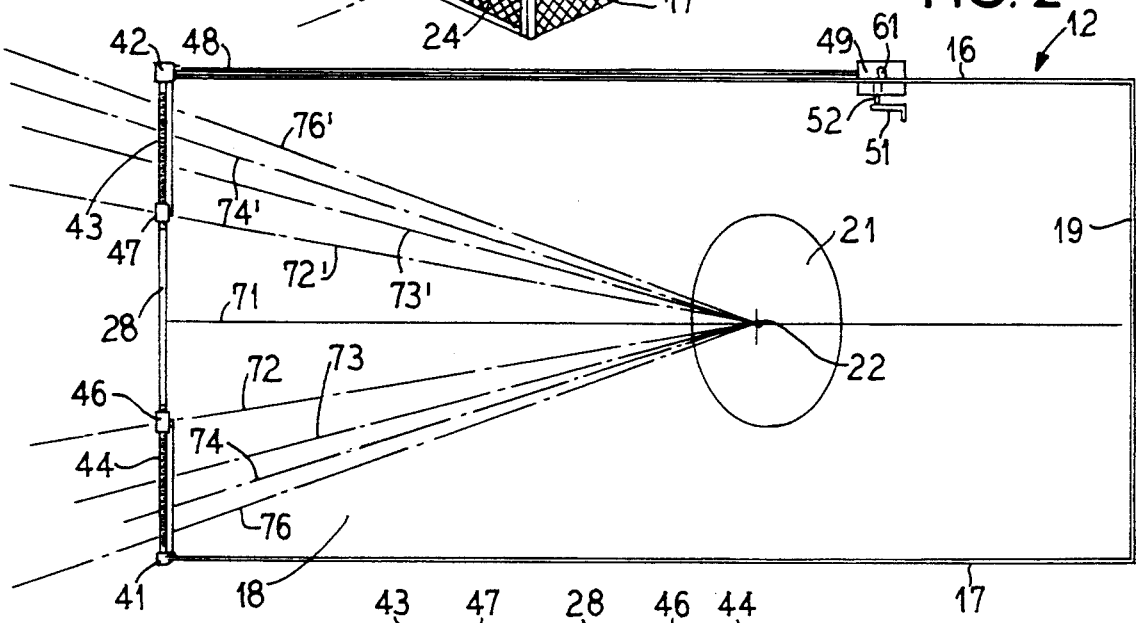
FIG. 2 is a top plan view of a golf tee area of the invention.

FIGS. 1 and 2 illustrate enclosed tee areas of the invention. A pair of enclosed tee areas 10 are illustrated in FIG. I which comprise a first tee area 11 and a second tee area 12 which are mounted side-by-side and have a common dividing wall 16. The tee area 11 has a second sidewall 14 and the tee area 12 has a second sidewall 17. The tee areas 11 and 12 are each formed with back walls such as the backwall 19 illustrated in tee area 12. The tee area 11 has a top wall 20 formed with a generally U-shaped opening 19 and the tee area 12 is formed with a top wall 25 formed with a generally U-shaped opening 21. The tee area 11 is formed with a pair of moveable doors 26 and 27 that move on a shaft 29 and the tee area 12 is formed with a pair of moveable doors 23 and 24 which are moveably mounted on a shaft 28.

The various walls of the tee areas 11 and 12 are formed of a mesh as, for example, a metal mesh made of aluminum, for example, or other suitable material. or synthetic material, the purpose of which is to absorb shock and not ricochet the ball and cause the golf to fall in a concentrated pattern for each pick-up.

FIG. 2 is a top plan view of the tee area 12 and illustrates a tee area 21 formed with a ball holder 22 from which the out-of-bound lines 72–76 extend. The out-of-bound lines such as 72–76 and 72' through 76' may be marked on the floor 18 of the tee area so that the adjustable doors 23 and 24 may be set to the desired out-of-bound line.

There may be different surfaces on the tee, such as sand, grass etc.

The shaft 28 is rotatably supported in bearings 41 and 42 at the upper opposite corners of the tee area 12 and carry coupling members 46 and 47 which are threaded and which are threadedly received on the threaded portions 43 and 44 of the shaft 28. The shaft 28 can be rotated with a shaft 48 which extends between the bearing 42 and a support member 49. A crank handle 51 that is connected to a shaft 52 that carries a worm 61 that meshes with a gear, not shown, drives the shaft 48. Shaft 48 also has a gear that meshes with a gear mounted on the shaft 28 such that when the handle 51 is rotated, the shaft 28 is rotated so as to move the collars 46 and 47 either toward or away from each other. The threads on the threaded portions 43 and 44 and the collars 47 and 46 are such that the collars 46 and 47 either move toward each other or away from each other depending on rotation of the crank 51. The flexible webbing which is connected between the sidewalls and the couplings 47 and 46 allows the opening from the tee area to be adjusted so that the opening corresponds to the various out-of-bound markers 72–76 and 72'–76' illustrated in FIG. 2 as selected by the golfer so as to set the out-of-bound markers to coincide with the particular hole being played.

Figure 3:
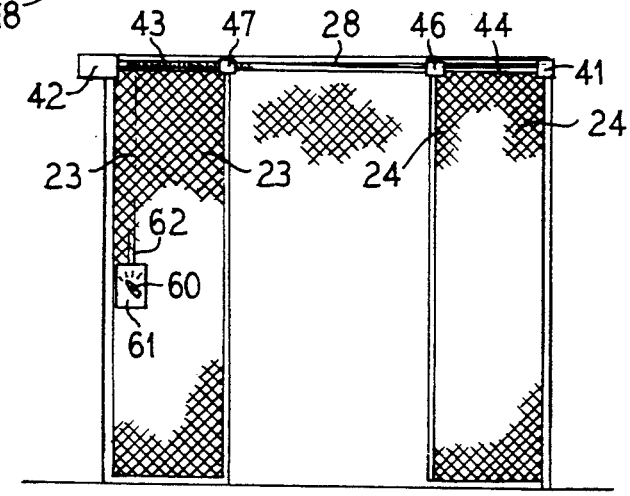
FIG. 3 is a front plan view of the golf tee area of the invention.

FIG. 3 is a modification of the invention wherein a motor 61 is provided with a controller 60 that can be adjusted by the player and which is connected by shaft 62 through suitable mechanical linkage, not shown, to drive the shaft 28 so as to adjust the doors 23 and 24.

FIGS. 4 and 5 illustrate a modification of the invention wherein the doors 23 and 24 have been replaced by swinging doors 98 and 99 which are mounted on hinges 106 and 107, respectively, at the front end of the tee area 12. Pivoted bars 109 and 113 are pivoted from pivot points 108 and 112 and pass through openings and set screw members 110 and 111, 114 and 116 mounted on the doors 98 and 99 such that when the set screws 111, 116 are loosened, the doors 98 and 99 can be swung so that their outer edges coincide with the reference out-of-bound lines indicias 42–46 and 72–76 so as to set the out-of-bound conditions by pivoting the doors from the solid line positions to the dash line position shown in FIG. 5.

FIG. 6 illustrates a different construction comprising an A-frame structure which has sidewalls 131 and 132 which meet at an apex 133 and which has fixed outer front wall portions 136 and 137 and pivoted moveable doors 138 and 139 that can be moved to different positions so as to set the out-of-bound marker lines to coincide with the actual holes. The doors 138 and 139 are shown in the full open position in solid line and in the full closed position in dash dot line. They, of course, can be positioned at any intermediate position between these limit positions to establish adjustable out-of-bound lines.

FIG. 7 illustrates in plan view a layout of a golf course 150 that has a playing field 149 upon which a matrix of golf greens 151 are formed. A first plurality of side-by-side golf tees 152 through 157 are mounted on one edge 148 of the golf area 149 and a second plurality of side-by-side tee areas 158–163 are mounted adjacent an edge 147 of the golf area 149. The edge 147 extends 90° to the edge 148 as shown. With the arrangement of FIG. 7, golfers can play toward the greens 151 aligned with their particular tee area 152–157 or 158–163 simultaneously without interference from each other. It is to be realized, of course, that tee areas could also be placed along one or both of the other two sides of the area 149 so as to allow more extensive usage of the playing area 149.

The tee area may also be enclosed on the top for inclement weather.

Although the invention has been described with respect to preferred embodiments, it is not to be so limited as changes and modifications can be made which are within the full intended scope of the invention as defined by the appended claims.

I claim:

1. An enclosed golf tee area comprising, an enclosure with a floor and first and second opposite side walls and an adjustable front wall defined by two moveable screen doors which are respectively connected to said first and second opposite side walls and can be moved to different positions, a golf tee position on said floor, a plurality of out-of-bound lines printed no said floor and extending from said tee position to said adjustable front wall and associated pairs of said plurality of out-of-bound lines which subtend different angles at said tee position and define different out-of-bound limits, and means for moving said two front screen doors so that the position of adjacent edges of said two front screen doors are respectively aligned with selected associated pairs of said plurality of out-of-bound lines so as to allow a selected out-of-bound angle to be selected.

2. An enclosed golf tee area according to claim 1 wherein said first and second screen doors are pivotally mounted to said first and second side walls.

3. An enclosed golf tee area according to claim 1 wherein said first and second screen doors are slidably connected to said first and second side walls.

4. An enclosed tee area according to claim 1 including motor means for moving said first and second screen doors.

* * * * *